US005374053A

United States Patent [19]

Doucet et al.

[11] Patent Number: 5,374,053

[45] Date of Patent: Dec. 20, 1994

[54] DEVICE FOR CHANGING THE TRANSPORT POSITION OF PRODUCTS

[75] Inventors: Louis J. Doucet, Salem, N.H.; Gilles L. Fecteau, Saco, Me.

[73] Assignee: Heidelberger Druckmaschinen AG, Heidelberg, Germany

[21] Appl. No.: 186,282

[22] Filed: Jan. 21, 1994

[51] Int. Cl.[5] ..... B65H 9/06

[52] U.S. Cl. ..... 271/243; 271/245; 271/273

[58] Field of Search ..... 271/243, 245, 273

[56] References Cited

U.S. PATENT DOCUMENTS 3,964,598 6/1976 Alsop ..... 271/243 X
4,863,152 9/1989 Milo .
5,147,092 9/1992 Driscoll ..... 271/245 X

FOREIGN PATENT DOCUMENTS 2184717 7/1990 Japan .

*Primary Examiner*—Richard A. Schacher
*Attorney, Agent, or Firm*—Tarolli, Sundheim & Covell

[57] ABSTRACT

A device for changing the transport position of products such as sheet material signature fed to further processing units includes movable upper transport (4) and movable lower transport (7) in a transport plane (29). Products (22) are guided by the upper and lower transport (4, 7) in the transport plane (29). An alignment element (14, 15) attached on a rotary body (8) cyclically diverts the upper transport. Simultaneously, the position of the products (22) on said lower transport (7) is corrected by engagement with an abutment surface (19) on the alignment element (14, 15).

25 Claims, 3 Drawing Sheets

DEVICE FOR CHANGING THE TRANSPORT POSITION OF PRODUCTS

BACKGROUND OF THE INVENTION

1. Technical Field

The present invention relates to a device for changing the transport position of products, and particularly of products fed to further processing units. In particular, the present invention relates to a device for aligning sheet material products such as newspaper or magazine signatures moving along a transport path so that the products are not skewed relative to the transport path.

2. Description of the Prior Art

U.S. Pat. No. 4,863,152 discloses a sheet material folding apparatus in which the spacing of sequential products from leading edge to leading edge is being reduced. Products to be transported are conveyed on a first conveyor belt at almost the speed of an upstream printing press. The products are then transferred to a second conveyor belt which moves at a lower conveying speed. The conveyor belts are preferably formed as vacuum belts, in order to lend support to the products to be conveyed; however, the products conveyed thereon are not aligned before they are fed into an angular longitudinal folding device. In order to maintain the products in position on the vacuum belts, suction means must be provided below the conveyor belts which secure the product to be folded also during the performance of the longitudinal fold. As a result, the products may be subjected to very strong mechanical forces which, in the case of very thin product materials, can even result in damage to the products. This type of suction system is costly and has a disadvantageous effect on product quality under certain conditions of production.

Japanese Patent Application No. 2-184717 discloses a mechanism for correcting the skew feeding of paper sheets. The paper sheets which are gripped by several transport rollers are conveyed by a conical roller against a side guide which aligns the sheets. The corrective movement of a paper sheet whose orientation is to be corrected initially takes place from the middle of the paper sheet. This device, too, puts high strain on thin product materials, which can cause damage to the individual products.

SUMMARY OF THE INVENTION

In view of the prior art mentioned above, it is the object of the present invention to provide for a position correction of products being transported, whereby the product material is handled gently.

It is a further object of the present invention to improve the precision of the feed of the products into a subsequent processing unit such as a folder.

It is a further object of the present invention to eliminate a costly vacuum system and thereby lower manufacturing cost.

The present invention is a device for changing the position of products being fed to a processing unit. The device includes movable upper and lower transport members for engaging upper and lower sides of the products and for moving the products in a transport plane. The device includes means for cyclically diverting the upper transport member away from the lower transport member and for simultaneously aligning the products between the upper and lower transport members. The means for diverting and for aligning includes a rotatable body having a product alignment element which moves into the transport plane to divert the upper transport member and to align the products.

The present invention is also a method of aligning the leading edge of a sheet material product perpendicular to a transport path along which the sheet material product is being transported by being gripped between parallel spaced upper and lower tapes moving at a transport speed. The method includes the steps of rotating an alignment element into a position in the transport path ahead of the sheet material product leading edge and disposed perpendicular to the transport path; engaging the upper tape with the alignment element to lift the upper tape off the sheet material product; moving the alignment element along the transport path ahead of the moving sheet material product at a speed lower than the transport speed; engaging the sheet material product leading edge with the alignment element to align the leading edge of the sheet material product perpendicular to the transport path; rotating the alignment element out of the transport path; and lowering the upper tape onto the sheet material product to grip the sheet material product between the upper and lower tapes.

The invention has the advantage that during alignment of the products being transported the mechanical strain on the products is drastically reduced, because of the diversion of the upper transport means. In this manner, the products can simply be slidingly moved on the lower transport means by the alignment elements. Furthermore, it is of great advantage that the alignment elements on the rotary body move at approximately the conveying speed of the products being transported, whereby any differences in speed occurring between the leading edge of the products and the alignment elements can be reduced to a minimum. This ensures alignment that is gentle on the products. After alignment, the products on the lower transport means, in their aligned state, are secured or clamped or gripped again by the upper transport means.

In a preferred embodiment of the invention, the rotational axis of the rotary body is oriented perpendicular to the transport path or conveying direction of the products. This has a uniform aligning effect on the products across their entire respective leading edges.

The rotary body can either be designed as a cylinder extending across the width of the transport plane, or as a plurality of individual disks connected for rotation with each other and arranged on a rotational axis. Each rotary body is provided with a flattened portion for easy attachment of the respective alignment element.

If the rotary body is designed as a cylinder extending across the width of the transport plane, a single alignment element extending across the entire width of the cylinder is attached. This single alignment element is provided with individual recesses for receiving the lower transport means, in order that the lower transport means may not be contacted or damaged. The respective recesses of the alignment element are defined by spaced edge portions which extend above the lower transport means to lift and separate the upper transport means from the upper side of the product. The alignment element edge portions thus cyclically divert the upper transport means from the transport plane as the rotary body rotates the alignment element into and out of the transport plane. Simultaneously, the leading edge of the more rapidly moving product is engaged by abutment surfaces on the more slowly moving alignment element. The product thus aligns itself with the alignment element, perpendicular to the transport path. Since the alignment element is moved along with the products, differences in speed between the products and the abutment surfaces of the alignment element are minimal, so that gentle handling of the products is ensured.

If the rotary body is formed as individual disks arranged side by side on the rotational axis, each respective disk is associated with one of a plurality of transport means. Each individual disk has an individual alignment element which likewise has a recess defined by spaced edge portions. Since these individual disks are arranged side by side, alignment of the products across the width of the transport plane is realized by this embodiment also.

The projected length of the envelope curve of the alignment element around the rotational axis of the rotary body corresponds to the cut-off length of a product, including gain, while the distance between the rotational axis of an upper tape roller and the alignment elements, which project perpendicularly into the transport plane, corresponds approximately to the cut-off length of a product.

BRIEF DESCRIPTION OF THE DRAWINGS

Further features and advantages of the present invention will become apparent to one of ordinary skill in the art to which the present invention pertains from a reading of the following description with reference to the accompanying drawings, in which.

DESCRIPTION OF PREFERRED EMBODIMENTS OF THE INVENTION

Figure 1:
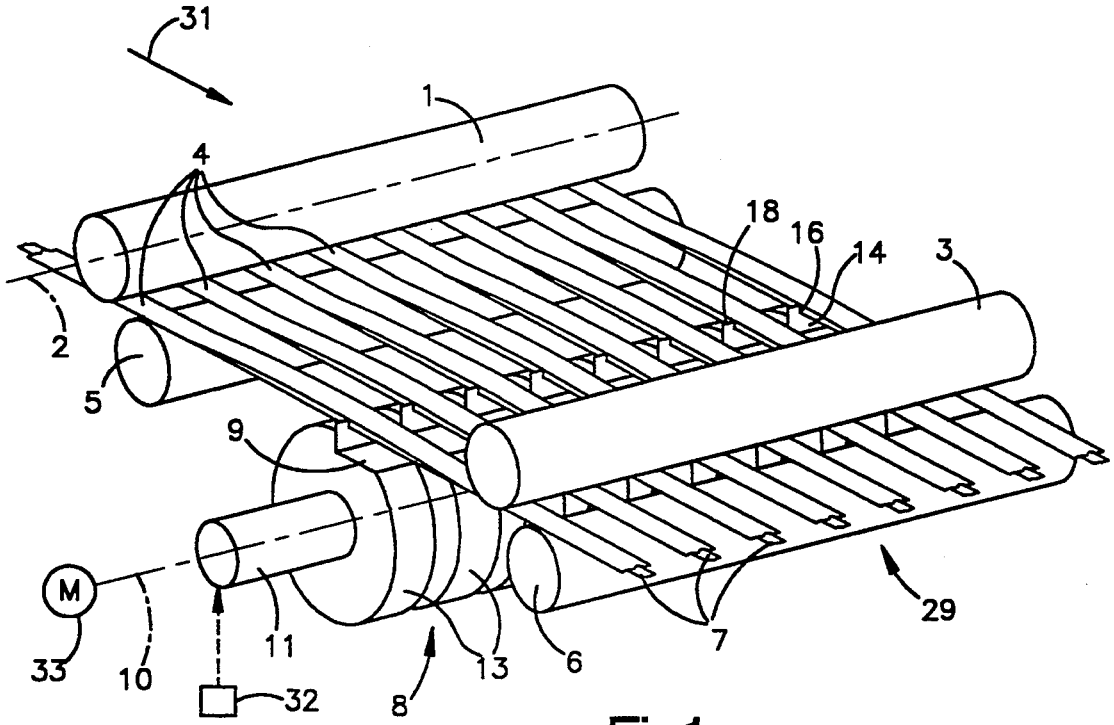
FIG. 1 is a pictorial perspective view of an alignment device in accordance with the present invention including a rotary body composed of individual disks arranged side by side and having respective individual alignment elements.

FIG. 1 shows a rotary body 8 composed of a plurality of individual disks 13 connected for rotation with each other and arranged side by side below a transport plane 29. Above the transport plane 29, there are arranged two spaced upper tape rollers 1 and 3. The tape roller 1 rotates around a rotational axis 2.

A plurality of parallel upper transport tapes 4, equally spaced from one another, move around the upper tape rollers 1 and 3. Below the transport plane 29, there are arranged two lower tape rollers 5 and 6, around which there move a plurality of parallel lower transport tapes 7. Each upper transport tape 4 overlies and is wider than its associated lower transport tape 7.

Below the transport plane 29, which is defined by the transport tapes 4 and 7, the rotary body 8 rotates around a rotational axis 10 and is mounted in a machine side wall (not shown) by its shaft 11. The axis 10 is vertically adjustable by moving the shaft 11 and rotary body 8 vertically, in a known manner with suitable structure indicated schematically at 32 for adjusting the position of a roll. The axis 10 is oriented perpendicular to a conveying direction or transport path 31 of the products 22.

On each of the disks 13, there is an alignment element 14 which is formed with a recess 16. Each recess 16 is defined by a pair of spaced-apart edge portions 18. Each recess is wider than the lower tape 7 but narrower than the upper tape 4. The individual alignment elements 14 are fixed on respective flattened portions 9 provided on each of the disks 13 in this specific embodiment.

Upon rotation of the rotary body 8—and thereby of the alignment elements 14—into the transport plane 29, the lower, narrower transport tapes 7 are received in the recesses 16. As shogun in FIG. 1, the upper transport tapes 4 are lifted by the alignment element edge portions 18, thereby releasing the frictional contact between the upper tapes and the upper side surface of a product 22 being transported. The product 22 is preferably a sheet material product such as a newspaper or magazine or book, or a signature thereof.

Figure 2:
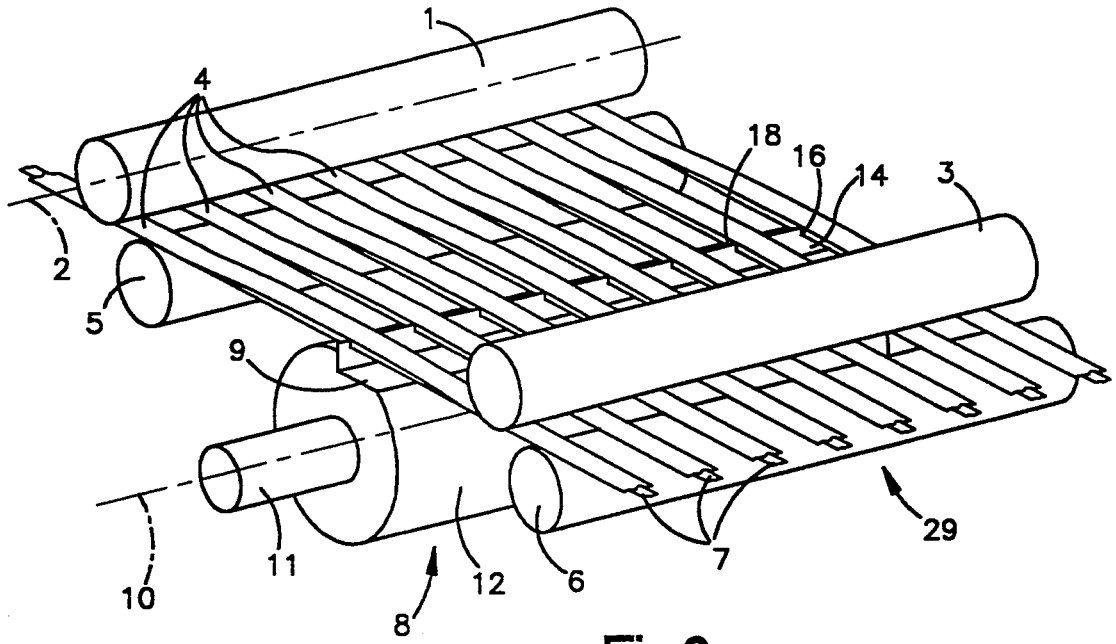
FIG. 2 is a view similar to FIG. 1 and showing a rotary body formed as a cylinder having a single alignment element.

FIG. 2 shows a rotary body designed as a cylinder which includes a single alignment element. In this embodiment of the invention, a cylinder 12 extending across the width of the transport plane 29 is used, in place of the multiple disks 13 arranged side by side. The cylinder 12, being borne by its shaft 11, rotates around a rotational axis 10. In place of multiple alignment elements 14 (see FIG. 1), the cylinder now has one single alignment element 15. This alignment element 15, being situated below the lower transport tapes 7, is provided with individual recesses 17, so that the lower transport tapes 7 may not be damaged during the rotation of the rotary body 8.

As in the embodiment according to FIG. 1, the upper transport tapes 4 are diverted upward from the transport plane 29 by the diverting edge portions 18 of the alignment element 15. In this manner, the upper transport tapes 4 release their grip on a product 22 being transported, which now merely rests on the lower transport tapes 7.

In FIGS. 3–7, the course of the alignment movement and diverting movement is illustrated in terms of the angular increments of the rotary body.

Figure 3:
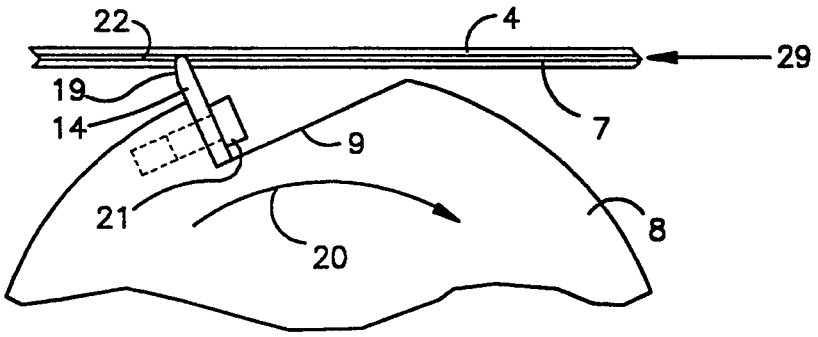
FIGS. 3–7 are a series of sequential views illustrating the course of movement of the alignment element through angular increments of the rotary body.

FIG. 3 shows an alignment element 14 in motion in the transport plane 29. The alignment element 14 is fixed on a flattened portion 9 of the rotary body 8 (be it a cylinder or a disk) by means of a screw connection 21. An abutment or engagement surface 19 is formed on that part of the alignment element which is opposed to the rotating direction 20 of the rotary body 8. The product 22 being transported is gripped between the upper and lower transport tapes 4 and 7 and, while being transported, engages the abutment surface 19 of the alignment element 14.

The rotary body 8 is rotated about the axis 10 by a suitable known means for rotating indicated schematically at 33. The rotation of the rotary body 8 is timed so that the alignment element (14 or 15) is cyclically moved into the transport plane 29 just ahead of a product 22 moving in the direction 31. The rotary body 8 is rotated at a speed of rotation such that the moving alignment element (14 or 15), when in the transport plane 29, moves at a speed slightly slower than the transport speed of the moving products 22. Thus, a product 22 can catch up to the more slowly moving alignment element 14 or 15 and can be slightly retarded thereby and thus be aligned by contact with the alignment element.

Figure 4:
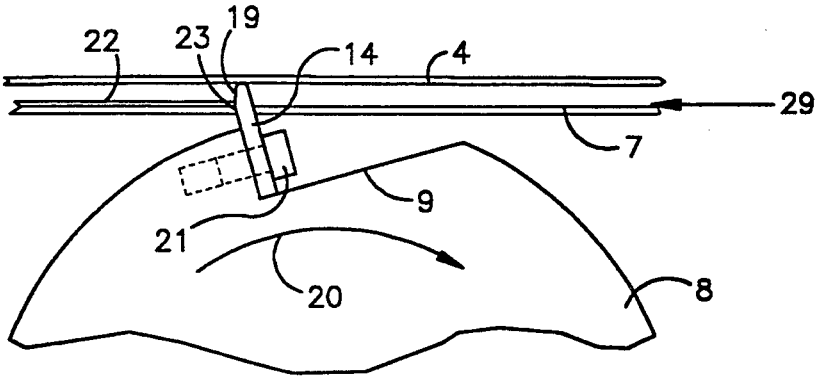

In FIG. 4, the upper transport tapes 4 start to be lifted or diverted from the transport plane 29 by the diverting edges 18 of the alignment element 14. The frictional contact between the upper transport tapes 4 and the upper side surface of the product 22 is thus interrupted. Simultaneously, the leading edge 23 of the product 22 engages the abutment surface 19 of the alignment element 14. The alignment element 14 is moving slightly slower than the transport speed of the product 22. Thus, a position correction of the product 22 on the lower transport tapes 7 can be achieved by the alignment element 14 moving into the transport plane 29 and engaging and aligning the moving product 22. The curvature of the abutment surface 19 facilitates the correction.

Figure 5:
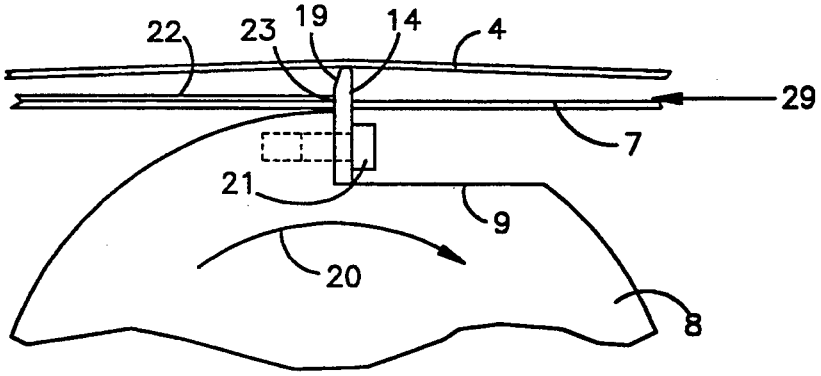

From FIG. 5, it can be recognized that when the projection of the alignment element 14 into the transport plane 29 is at its maximum, the diversion of the upper transport tapes 4 from the transport plane 29 is also at its maximum. As first seen in FIG. 4 and continued in FIG. 5, the frictional contact between the upper transport tapes 4 and the upper side of the products 22 is gradually negated, whereby an easier and consequently more careful manner of alignment of the products 22 is possible at the abutment surface 19. The products 22 merely rest on the lower transport tapes 7 and, thus, their position can be influenced more easily by sliding the products along the lower tapes. Because the abutment surfaces 19 extend across the width of the transport plane 29—be it on the alignment elements 14 or 15—a uniform effect on the products 22, particularly on their leading edges 23, is ensured, and the strain exerted on the material of the products is almost none.

Figure 6:
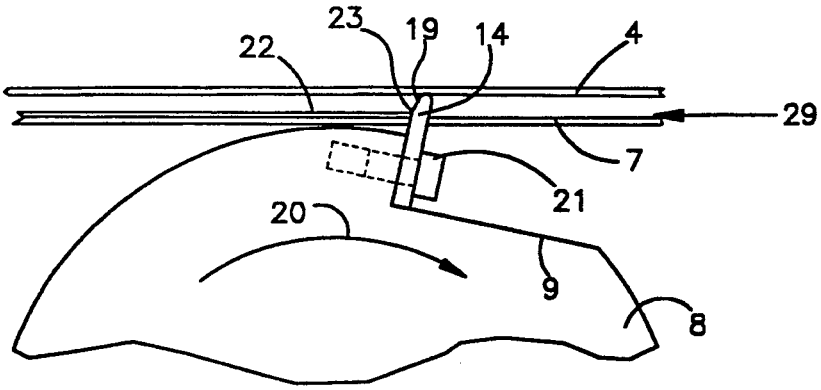

In FIG. 6, the alignment element 14 rotates downward again out of the transport plane 29. The products 22 engaging the abutment surface 19 gradually are captured or clamped or gripped in their correct (aligned) position as the upper transport tapes 4 are lowered into the transport plane 29 and grip the upper side surface of the products 22.

Figure 7:
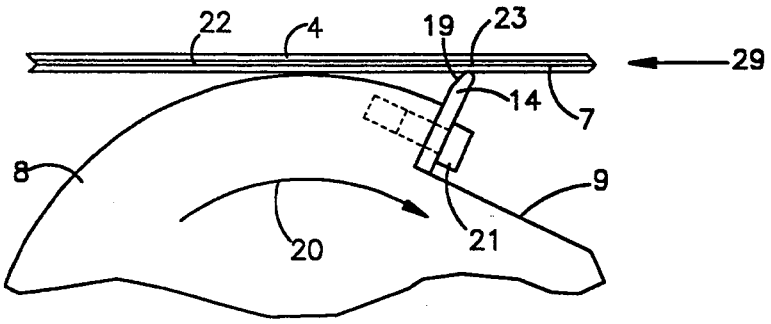

In FIG. 7, the alignment elements 14 are completely out of the transport plane 29. The product 22, being in an aligned transport position, now is gripped by the upper and lower transport tapes 4 and 7 and guided along the transport path.

Through the sequence illustrated in FIGS. 3–7, the distance along the tapes 4 and 7 between the individual products 22 to be transported, as well as the position on the tapes 4 and 7 of individual displaced or twisted products 22, can easily be corrected on the lower transport tapes 7. This enables a considerable improvement, for example, of the quality of a folding operation in a subsequent folding unit (not shown) into which the products 22 are directed.

Figure 8:
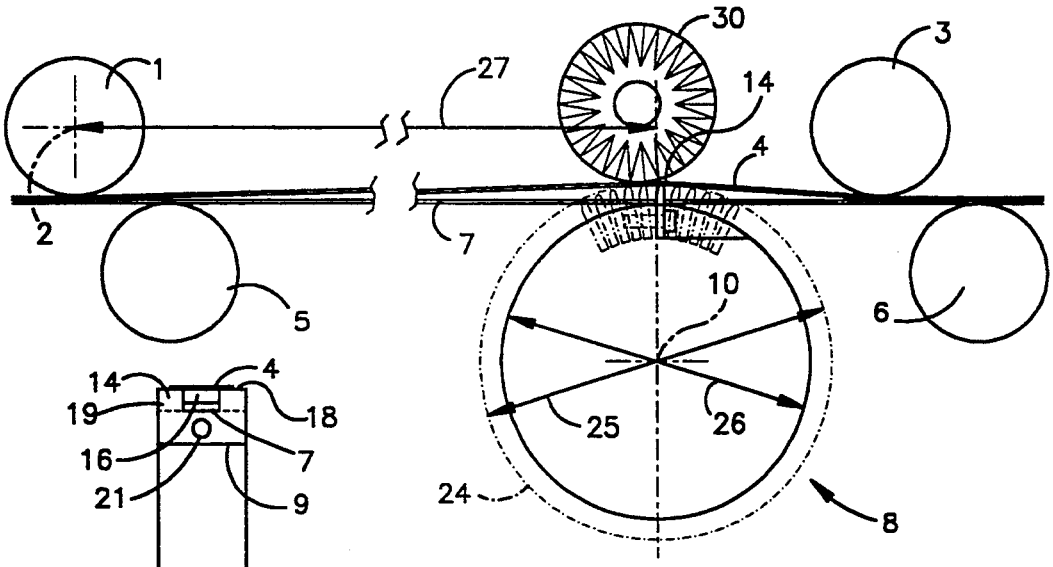
FIG. 8 is a schematic side elevational view of the alignment device of FIG. 1 and showing a brush roller.

Complementary to FIG. 1, FIG. 8 shows the geometric relations between the product 22 and the rotary body 8. The alignment element 14 or 15 attached to the rotary body—be it a plurality of disks 13 or one cylinder 12—describes an envelope curve 24. The highest point of the envelope curve 24 reaching into the transport plane 29 defines the maximum diversion or lifting of the upper transport tapes 4. The diameter of the envelope curve is indicated with the arrow 25.

A vertical adjustment of the rotational axis 10—and therewith of the rotary body 8—enables a degree of diversion of the upper transport tapes 4 which is adapted to the quality or thickness of the material of the products 22 being processed. If a product 22 is thicker than normal, it may be necessary, for example, to divert the upper transport tapes 4 farther from the transport plane 29.

Additionally, a vertical adjustment of the rotary axis 10 together with its rotary body 8 causes a change of the correction value established by this device with respect to the products 22 whose position on the lower transport tapes 7 is adjusted accordingly. The correction value of the products 22 is dependent on the radius at which the products 22 transported in the transport plane 29 abut at the alignment elements 14 of the rotary body 8. The smaller the radius, the slower the alignment element 14 is moving, and so the bigger is the correction value for which the products 22 on the lower transport tapes 7 are aligned.

The vertical adjustment of the rotary axis 10, however, does not influence the relative speed between the upper transport tapes 4 and the alignment element 14. But when the alignment element 4 is vertically adjusted with respect to the rotary body 8, the relative speed between the upper transport tapes 4 and the alignment element 14 changes.

The projected length of the envelope curve 24 corresponds to the cut-off length of the products 22 plus gain. In the device shown in FIG. 8, there is performed a cut-off during one revolution of the rotary body 8. It would also be possible to arrange two or more alignment elements 14 on the circumference of the rotary body 8, whereby the number of alignment elements 14 would have to correspond to the number of cut-offs per revolution. The distance 27 between the rotational axis 2 of the upper tape roller 1 and the alignment element 14 reaching perpendicularly into the transport plane is somewhat greater than the cut-off length of the products 22.

In order to maintain the contact between the products 22 and the lower transport tapes 7, one or more brush rollers 30 can be arranged in the spaces between the transport tapes 4, 7. In the embodiment shown in FIG. 8, the brush rollers 30 are provided opposite the rotary body 8 having an alignment element 14.

Figure 9:
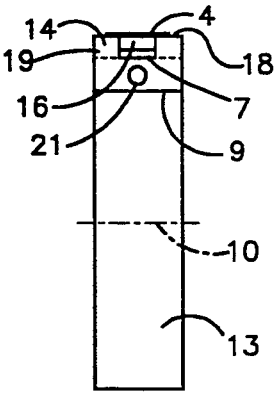
FIG. 9 is a schematic front elevational view of a single disk rotary body with an alignment element.

FIG. 9 is a front view of an alignment element 14 on a disk 13. The alignment element 14 is attached on the flattened portion 9 of the disk 13 rotating around a rotational axis 10. The alignment element 14 is fastened to the disk 13 by means of a screw connection 21, so as to be displaceable in vertical direction, if required. In the middle of the alignment element 14, there is formed a recess 16 within which the lower transport tape 7 moves while the upper transport tape 4 rests on the diverting edge portions 18 of the alignment element. On the rear part of the alignment element 14, the slightly curved abutment surface 19 is formed.

Figure 10:
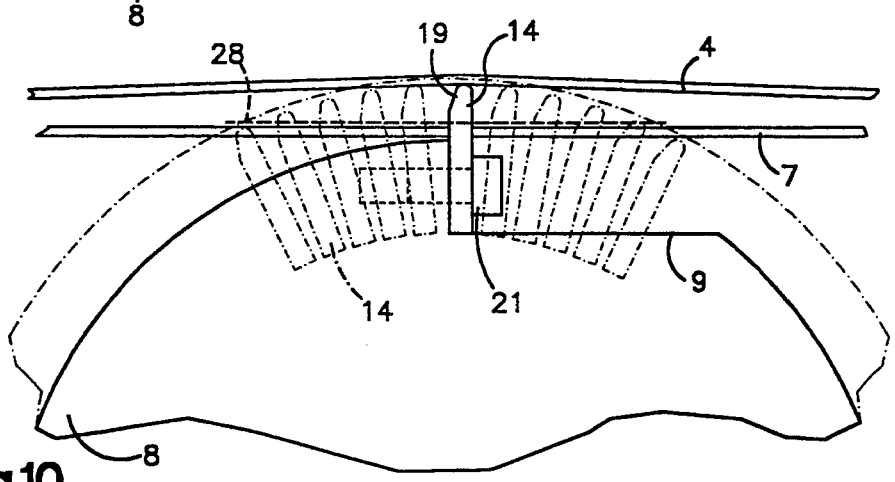
FIG. 10 is a view similar to FIGS. 3–7 illustrating the locations where an imaginary product leading edge would be if an alignment had not taken place.

FIG. 10 shows how an imaginary product leading edge 28 would be positioned on the lower transport tapes 7 if the products were not aligned. For the sake of illustration, the position of an imaginary product leading edge 28 is compared with a corresponding position of the alignment element 14 shown in small angular increments. With the present invention, an undesired change of position of the products 22 during transport before entering into a further processing unit such as a folder can effectively be prevented.

From the above description of the invention, those skilled in the art will perceive improvements, changes and modifications in the invention. Such improvements, changes and modifications within the skill of the art are intended to be covered by the appended claims.

Having described the invention, the following is claimed:

1. A device for changing the position of products being fed to a processing unit, said device comprising:

movable upper and lower transport means for engaging upper and lower sides of the products and for moving the products in a conveying direction in a transport plane; and means for cyclically diverting the upper transport means away from the lower transport means and for simultaneously aligning the products between the upper and lower transport means, said means for diverting and for aligning comprising a rotatable body having a product alignment element which moves into said transport plane to divert said upper transport member and to align the products.

2. A device according to claim 1, wherein said rotary body is rotatable about a rotational axis oriented perpendicular to the conveying direction of the products.

3. A device according to claim 2, wherein said rotational axis of said rotary body is adjustable vertically with respect to the conveying direction of said products.

4. A device according to claim 1, wherein said rotary body includes a flattened portion, said alignment element being vertically adjustably mounted on said flattened portion.

5. A device according to claim 1, wherein the rotary body comprises a cylinder extending across the width of the transport plane.

6. A device according to claim 5, wherein said alignment element on said cylinder extends across the width of the transport plane.

7. A device according to claim 5, wherein said alignment element on said cylinder includes surfaces defining a plurality of recesses below the lower transport means.

8. A device according to claim 7, wherein the individual recesses of the alignment element are defined by diverting edge portions.

9. A device according to claim 8, wherein the diverting edges separate said upper transport means from said products and divert said upper transport means from the transport plane.

10. A device according to claim 6, wherein the alignment element is provided with an abutment surface for said products.

11. A device according to claim 1, wherein said rotary body comprises a plurality of individual disks connected for rotation with each other side by side about a rotational axis.

12. A device according to claim 11, wherein each of said disks is associated with respective movable upper and lower transport means.

13. A device according to claim 12, wherein each of said disks comprises an alignment element which is provided with a recess.

14. A device according to claim 13, wherein said recess is defined by diverting edges.

15. A device according to claim 14, wherein the diverting edges of said recesses separate the upper transport means from the product and divert said upper transport means from the transport plane.

16. A device according to claim 13, wherein each of said alignment elements on said disks is provided with an abutment surface.

17. A device according to claim 1, comprising an upper tape roller rotatable about a second axis and supporting said upper transport means, wherein the projected length of the envelope curve of said alignment element moving around said rotational axis of said rotary body corresponds to the cut-off length plus gain of a product, and the distance between said rotational axis of said upper tape roller and said alignment element extending perpendicularly into the transport plane is greater than the length of the product.

18. A device as set forth in claim 1 comprising means for rotating said rotatable body about an axis of rotation spaced from said transport plane, said product alignment element being fixed for rotational movement with said rotatable body about said axis of rotation between a first position disposed out of said transport plane and a second position extending into said transport plane.

19. A device as set forth in claim 18 wherein said product alignment element has a first portion engageable with said upper transport means when said product alignment element is in the second position and a second portion engageable with a respective product moving in the transport plane, said first portion of said product alignment element comprising first surface means on said product alignment element for engaging said upper transport means and for moving said upper transport means out of the transport plane and away from the respective product being transported.

20. A device as set forth in claim 19 wherein said second portion of said product alignment element comprises second surface means on said product alignment element for engaging a leading edge portion of the respective product and for aligning the respective product relative to the conveying direction.

21. A device as set forth in claim 20 wherein said means for rotating comprises means for moving said product alignment element second surface means at a speed along said transport path slower than the speed of the moving products whereby the product leading edge portion engages said second surface means to retard movement of the product and thereby align the product.

22. A device as set forth in claim 21 wherein said axis of rotation and said second surface means extend perpendicular to the conveying direction.

23. A device as set forth in claim 1 wherein said movable upper and lower transport means comprise upper and lower tapes movable along a transport path in said transport plane and engaging respective upper and lower side surfaces of the products being transported;

said means for cyclically diverting comprising means for rotating said rotatable body about an axis of rotation spaced from said transport plane and extending perpendicular to the conveying direction;

said product alignment element comprising a first portion having first surface means for engaging said upper tape and for lifting the upper tape off said upper side surface of the products when said product alignment element moves into said transport plane;

said product alignment element comprising a second portion having second surface means for engaging respective leading edge portions of the products when said product alignment element moves into said transport plane;

said product alignment element second surface means extending perpendicular to the conveying direction;

said means for rotating comprising means for moving said second surface means of said product alignment element in the conveying direction at a speed slower than the transport speed of the products being transported.

24. A device as set forth in claim 23 wherein said product alignment element is sequentially movable upon rotation of said rotatable body from:

a first position disposed below said transport plane and spaced apart from said upper and lower tapes and from the products being transported; and thereafter to a second position extending into said transport plane, with said first surface means engaging said upper tape and lifting the upper tape off said upper side surface of the products, and with said second surface means engaging a leading edge portion of a respective product; and thereafter to a third position disposed on an opposite side of the second position from said first position and below said transport plane and spaced apart from said upper and lower tapes and from the products being transported.

25. A method of aligning the leading edge of a sheet material product perpendicular to a transport path along which the sheet material product is being transported by being gripped between parallel spaced upper and lower tapes moving at a transport speed, said method comprising the steps of:

rotating an alignment element into a position in the transport path ahead of the sheet material product leading edge and disposed perpendicular to the transport path;

engaging the upper tape with the alignment element to lift the upper tape off the sheet material product;

moving the alignment element along the transport path ahead of the moving sheet material product at a speed lower than the transport speed;

engaging the sheet material product leading edge with the alignment element to align the leading edge of the sheet material product perpendicular to the transport path;

rotating the alignment element out of the transport path; and lowering the upper tape onto the sheet material product to grip the sheet material product between the upper and lower tapes.

* * * * *